United States Patent [19]

Izumisawa et al.

[11] Patent Number: 4,735,568

[45] Date of Patent: Apr. 5, 1988

[54] WICKS FOR OIL BURNING APPLIANCE

[75] Inventors: Mamoru Izumisawa, Yao; Yoshiomi Sasaki, Kobe; Atsuo Hashizume, Kyoto; Hideichi Hiramatsu, Yao, all of Japan

[73] Assignees: Silver Industrial Co., Ltd.; Teijin Shoji Kaisha, Ltd., both of Osaka, Japan

[21] Appl. No.: 896,588

[22] Filed: Aug. 18, 1986

Related U.S. Application Data

[63] Continuation of Ser. No. 620,795, Jun. 14, 1984, abandoned, which is a continuation-in-part of Ser. No. 448,504, Dec. 9, 1982, abandoned.

[30] Foreign Application Priority Data

Dec. 10, 1981 [JP] Japan ..... 56-183973

[51] Int. Cl.[4] ..... F23D 3/18

[52] U.S. Cl. ..... 431/325; 431/298

[58] Field of Search ..... 431/325, 298, 320; 239/145; 126/96

[56] References Cited

U.S. PATENT DOCUMENTS

| | | | |
|---|---|---|---|
| 37,237 | 12/1862 | McKee | 431/325 |
| 37,276 | 1/1863 | Connelly | 431/325 |
| 253,666 | 2/1882 | Beck | 431/325 |
| 388,609 | 8/1888 | Yañez | 431/298 |
| 467,871 | 1/1892 | Draper | 431/325 |
| 652,548 | 6/1900 | Neustaedter | 431/325 |
| 752,575 | 2/1904 | Mosher | 431/325 |
| 876,523 | 1/1908 | Burrows | 431/325 |
| 1,981,107 | 11/1934 | Jefferson | 431/298 |
| 2,013,442 | 9/1935 | Hughes | 431/325 |
| 2,371,006 | 3/1945 | Weaver | 431/325 |
| 2,376,083 | 5/1945 | Quinn | 431/325 |
| 4,569,656 | 2/1986 | Shimizu et al. | 431/298 |

FOREIGN PATENT DOCUMENTS

| | | | |
|---|---|---|---|
| 0005229 | 1/1979 | Japan | 431/298 |
| 0133510 | 10/1981 | Japan | 431/325 |
| 0146904 | 11/1981 | Japan | 431/325 |
| 0049709 | 3/1982 | Japan | 431/325 |
| 0060108 | 4/1983 | Japan | 431/325 |
| 8103692 | 12/1981 | PCT Int'l Appl. | 431/320 |
| 0572947 | 10/1945 | United Kingdom | 431/325 |

OTHER PUBLICATIONS

Marjory Joseph—*Introductory Textile Science*—4th Ed., N.Y.; CBS College Publishing, Inc. (1981) pp. 205–256.

*Primary Examiner*—Samuel Scott
*Assistant Examiner*—H. A. Odar
*Attorney, Agent, or Firm*—Wenderoth, Lind & Ponack

[57] ABSTRACT

A wick for use in a burning appliance consisting of (A) a fuel absorbing section composed of a plurality of short fiber web layers forming its outermost layers and one or a plurality of long fiber layers of numerous long fibers aligned substantially in one direction and (B) a heat-resistant burning section adjacent to the fuel absorbing section. The long fiber layers and the short fiber web layers are physically united into an inseparable integral structure by, for example, needle-punching or stitch-bonding. The wick has a high rate of fuel absorption and permits burning of a fuel at a high caloric output.

20 Claims, 3 Drawing Sheets

Fig. 1
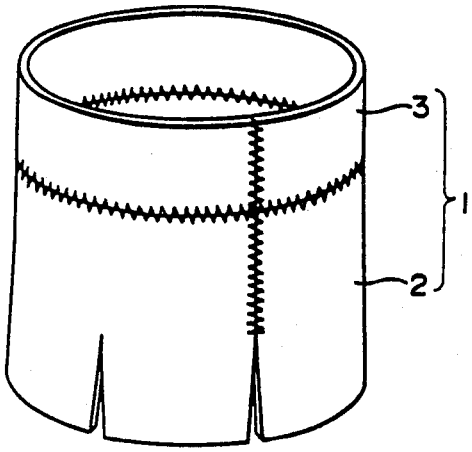
Fig. 2
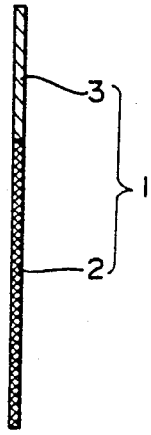
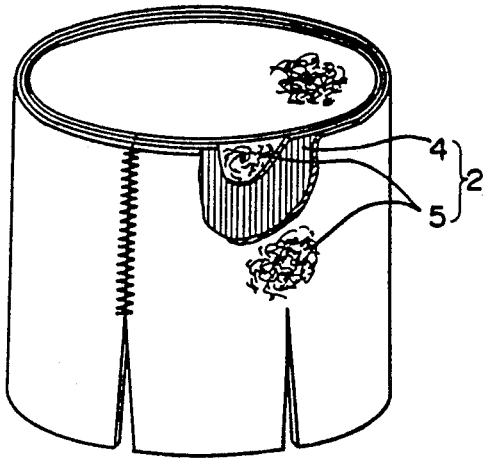
Fig. 3
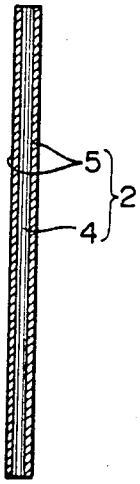
Fig. 4

WICKS FOR OIL BURNING APPLIANCE

CROSS-REFERENCE TO RELATED APPLICATION

The present application is a continuation of now abandoned application Ser. No. 620,795 filed June 14, 1984, which is a continuation-in-part of now abandoned application Ser. No. 448,504 filed Dec. 9, 1982.

BACKGROUND OF THE INVENTION

1. Field of the Invention

This invention relates to a wick for oil burning appliances, and more specifically, to a wick for oil burning appliances using liquid fuels such as kerosene, for example, kerosene stoves and kerosene space heaters, etc.

2. Description of the Prior Art

A wick for use in oil burning appliances consists of a fuel absorbing section in which a liquid fuel is absorbed by capillary action, and a burning section in which the absorbed fuel is burned to produce high temperatures. Although the fuel absorbing section and the burning section cannot be clearly distinguished from each other, the wick being used in a burning appliance may be significantly evaluated by dividing it conceptually into the fuel absorbing section and the burning section and assessing the performance of each of these sections.

A typical example of the wick which has long been used in burning appliances consists of a fuel absorbing section composed of a thick woven fabric of cotton yarns or cotton/rayon blended yarns, and upwardly thereof, a burning section composed of a flame-resistant thick woven fabric of glass fiber yarns or glass fiber/-carbon fiber blended yarns, for example, PYROMEX (a trade name for a product of Toho Rayon Co., Ltd.). Conventional wicks having such a structure are described, for example, in Japanese Laid-Open patent publication No. 5229/1979 and U.S. Pat. No. 1,651,209. The former discloses a wick consisting of a burning section composed of heat-resistant fibers such as glass fibers and asbestos, and a fuel absorbing section composed of a woven fabric of hydrophobic and oleophilic synthetic fibers such as polypropylene and polyethylene fibers, the two sections being sewn together. The latter discloses a wick consisting of a lower portion of cotton and an upper portion of an asbestos woven fabric.

These conventional wicks, however, have the defect that since a special loom must be used to produce the thick woven fabric the productivity is low and the cost of production is high. Specifically, the thick woven fabric is produced by using ultrathick cotton yarns, for example 8 folded yarns of $10^s$, as warps. Moreover, the fabric has a special weave and a small width. For this reason, such a woven fabric cannot be produced on an ordinary loom nor with high productivity.

There has been known an attempt to produce a thick wick for burning appliances without using a special loom by a method which comprises separately providing a woven or knitted cloth composed mainly of glass fibers and a felt having a flat smooth surface and composed mainly of glass wool, laying the felt over one or both surfaces of the woven or knitted cloth, and needle-punching the assembly by a needling machine to unite them into a unitary structure (see Japanese utility model publication No. 13978/1970). According to the disclosure of this patent document, the wick has the advantage that because the fibers of the felt are entangled with the woven or knitted cloth, the fuel is prevented from flowing down along the woven or knitted cloth, and therefore, the burning can be started rapidly upon re-ignition.

Wicks of similar structures are disclosed in Japanese Laid-Open utility model publication No. 75434/1975 in which a felt obtained by entangling metallic fibers or carbon fibers and compressing the entangled mass is used instead of the felt having a flat smooth surface and composed mainly of glass wool similar wicks are also disclosed in Japanese Laid-Open utility model publication No. 140732/1974 in which a felt composed mainly of carbonized wool-like acrylic fibers having higher heat resistance than glass fibers is used instead of the aforesaid felt. Since these wicks use a woven or knitted fabric composed mainly of glass fibers, it is apparent that they have an improved oil-retaining property as in the aforesaid wick.

U.S. Pat. No. 214,085 discloses a lamp-wick consisting of one or more layers of parallel threads of fine-spun glass enclosed in a textile material, the whole being sewed together by a series of parallel longitudinal stitches. The lamp-wick of the prior art is produced by enclosing one or more layers of parallel threads of glass in a textile material and sewing the whole together. Since the glass threads are liable to spread easily, a great deal of effort is required in maintaining them parallel to each other. Furthermore, since the outermost layer of the wick is the textile material, channels tend to form longitudinally along stitches during the stitching operation. Therefore, the manufacturing process is complex and unsuitable for mass production. The longitudinal channels worsen the fit of the wick with the wick guiding slit of a burning appliance. Furthermore, as the temperature of the oil rises by burning, the gas in the oil tank goes up along these channels to flame up intermittently. There also is a danger of ready leakage of the oil in the event of overturning the burning appliance. In addition, since the textile material is stitched, the wick has the defect of shrinking when immersed in the oil.

SUMMARY OF THE INVENTION

It is an object of this invention therefore to provide a wick of a novel structure for use in a burning appliance.

Another object of this invention is to provide a wick for use in a burning appliance, which absorbs a liquid fuel such as kerosene at a high rate and therefore can generate a large amount of heat by permitting the burning of a large quantity of the fuel.

Still another object of this invention is to provide a wick for use in a burning appliance, which absorbs a liquid fuel at a high rate and, therefore, can allow a large distance between the surface of a liquid fuel in a tank and the upper end of the burning section of the wick and prevent the liquid fuel from being heated to a high temperature and consequently gasified and exploded, and thus enable the fuel to continue to burn safely.

A further object of this invention is to provide a wick for use in a burning appliance, which has a high rate of absorbing a liquid fuel and therefore can permit smooth ignition (re-ignition) or continued burning.

A still further object of this invention is to provide a wick for use in a burning appliance, which can be produced easily at low cost by simple operations.

Yet another object of this invention is to provide a wick for use in a burning appliance, which has excellent dimensional stability to heat and moisture not only during storage before mounting on the burning appliance but also during use in the burning appliance, and which, therefore, is prevented from shrinking gradually when heated in the burning appliance and failing to move up and down smoothly within a metallic wick guiding slit.

An additional object of this invention is to provide a wick for use in a burning appliance, which has a smooth surface and therefore fits closely with a wick guiding cylinder without leaving a gap so that in the event of overturning of the burning appliance, oil leakage hardly occurs.

These objects and advantages of this invention are achieved by a wick for use in a burning appliance, comprising (A) a fuel absorbing section composed of one or a plurality of long fiber layers of numerous long fibers aligned substantially in one direction and a plurality of short fiber random web layers, said long fiber layers and said short fiber web layers being alternately stacked so that the short fiber web layers form the outermost layers of the absorbing section, and being physically united into an inseparable integral structure, and (B) a heat-resistant burning section adjacent to the fuel absorbing section.

The wick of this invention is of such a structure that the fuel absorbing section (A) and the heat-resistant burning section (B) can be clearly distinguished physically.

BRIEF DESCRIPTION OF THE DRAWINGS

FIG. 1 is a schematic perspective view of a cylindrical wick according to one embodiment of the wick of this invention;

FIG. 2 is a rough sectional view taken longitudinally of the wick of FIG. 1;

FIG. 3 is a partly broken-away perspective view of the fuel absorbing section of the cylindrical wick of this invention;

FIG. 4 is a sectional view taken longitudinally of the wick of FIG. 3;

DETAILED DESCRIPTION OF THE PREFERRED EMBODIMENTS

Figure 5:
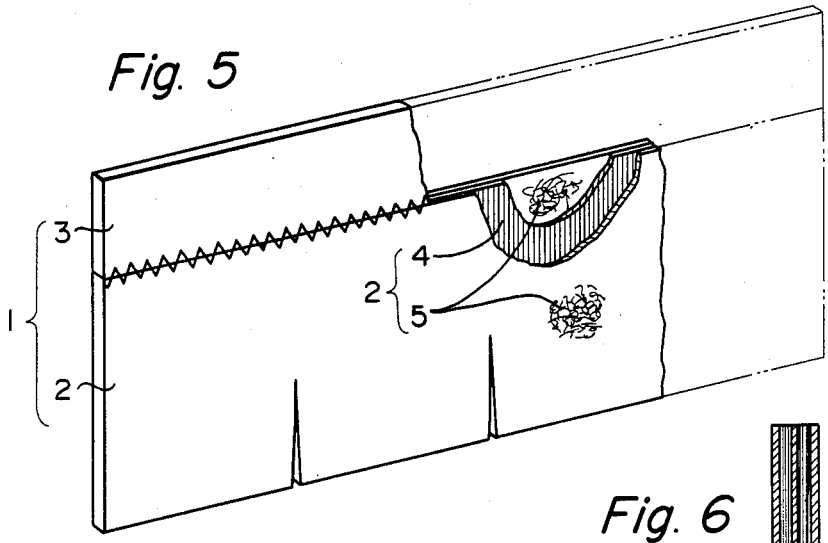
FIG. 5 is a partly broken-away perspective view of a flat plate-like wick according to another embodiment of the wick of this invention.

The fuel absorbing section (A) of the wick of this invention is composed of one or a plurality of long fiber layers ($A_1$) of numerous long fibers aligned substantially in one direction, and a plurality of short fiber random web layers ($A_2$).

Since the fuel absorbing section of the wick is physically distinct from the heat-resistant burning section as mentioned above and has a high rate of absorbing a fuel, it is cooled by the fuel which it absorbs. The long fiber layers ($A_1$) and the short fiber random web layers ($A_2$), therefore, do not always have to be made of heat-resistant materials.

The numerous long fibers forming the long fiber layers may, for example, be cellulose acetate fibers, polyamide fibers, acrylic fibers, polyester fibers, polyvinyl formal fibers, polyethylene fibers, polypropylene fibers, polyvinyl chloride fibers, wholly aromatic polyamide fibers, rayon, carbon fibers, or glass fibers. Fibers of polyamides such as 6-nylon and 6,6-nylon, polyesters such as polyethylene terephthalate, polyethylene and polypropylene are preferred because they can be easily obtained industrially.

The long fiber layers may be composed of one kind of such long fibers or a mixture of at least two kinds of these fibers.

Preferably, these long fibers have a diameter of about 0.003 to about 0.03 mm, and the long fibers from thermoplastic resins are those which are dawn or drawn and heat-set.

The short fiber random web layers ($A_2$) may be composed of, for example, cellulose acetate fibers, polyamide fibers, acrylic fibers, polyester fibers, polyvinyl formal fibers, polyethylene fibers, polypropylene fibers, polyvinyl chloride fibers, wholly aromatic polyamide fibers, rayon, carbon fibers, glass fibers, cotton, flax or wool. Preferred are webs of fibers having high resistance to heat shrinkage, such as rayon, wholly aromatic polyamide fibers, carbon fibers, glass fibers, cotton or flax.

These long fibers and short fiber webs are produced by methods known per se.

In each long fiber layer ($A_1$), a plurality of the aforesaid long fibers are aligned substantially in one direction. This can be achieved, for example, by spreading a non-twisted tow of a plurality of long fibers gradually while it is mechanically vibrated (see, for example, Japanese patent publication No. 6795/1976); or by providing a plurality of reels having non-twisted multifilaments wound thereon, withdrawing a plurality of filaments therefrom, and aligning them in one direction.

In order to prevent the filaments in the long fiber layer from separating randomly, an adhesive, such as an acrylate-type adhesive, may be applied, as required, to the filaments during or after aligning. This temporarily imparts shape retention to the long fiber layer which is effective until the step of uniting it with short fiber web layers. A plurality of such long fiber layers may be stacked in order to obtain the desired oil absorbing capacity.

The short fiber random web layers may be produced by an ordinary machine, such as a carding machine or a garnett machine. A specific method of manufacturing the short fiber random web layer is disclosed, for example, in Nicely, "Tappi", July 1966, vol. 49, No. 7, page 115A.

Figure 6:
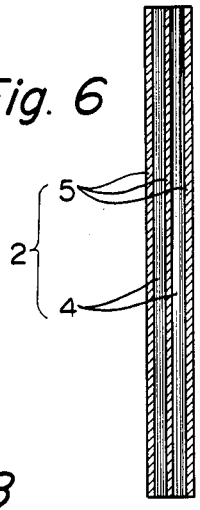
FIG. 6 is a sectional view of the fuel absorbing section of the wick of this invention which is formed by alternately stacking three short fiber random web layers and two long fiber layers so that the short fiber random web layers form the outermost layers.

In the wick of this invention. the fuel absorbing section consists of one or a plurality of the long fiber layers ($A_1$) and a plurality of short fiber random web layers ($A_2$). It may have various structures, for example ranging from the most simple structure as shown in FIGS. 3 and 4 which consists of one intermediate long fiber layer (4) and two outside short fiber random web layers (5), to a structure consisting of a plurality of the long fiber layers and a plurality of the short fiber random web layers stacked alternately so that the short fiber random web layers constitute the outermost layers of the structure. FIG. 6 shows the structure of a fuel absorbing section consisting of two long fiber layers 4 and three short fiber random web layers 5.

In the fuel absorbing section, the long fiber layers and the short fiber random web layers should be physically united into an integrated structure so as to avoid delamination. This can be achieved, for example, by needle punching or stitch bonding. A chemical means of, for example, bonding them into a unitary structure with an adhesive cannot be used in this invention because the adhesive will be degraded or dissolved upon repeated contact with a liquid fuel over an extended period of time and this will finally result in the delamination of the long fiber layers from the short fiber random web layers.

It has been found desirable that such needle punching should be carried out at a density of 50 to 400/cm$^2$ of the outermost surface on an average. This needle punching density is high enough to prevent delamination even after the wick has been used for an extended period of time, and does not adversely affect the high fuel absorbing rate contemplated by this invention.

For the same reason, it has also been found desirable that in stitch bonding, stitch yarns with a pitch of 1.5 to 5 mm extending from the surface to the back of the structure exist at a density of 10 to 60 per 10 cm.

Figure 7:
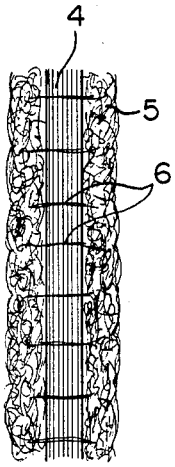
FIG. 7 is a schematic sectional view illustrating the needle-punched state of the fuel absorbing section of the wick of this invention.
Figure 8:
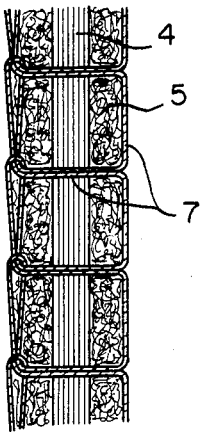
FIG. 8 is a schematic sectional view illustrating the stitch-bonded state of the fuel absorbing section of the wick of this invention.

As shown in FIG. 7, in needle punching, needle barbs cause the short fibers 6 of the web 5 to extend from one surface of the structure to the other, and the long fiber layers and the short fiber random web can be uniformly integrated into a unitary structure. The resulting wick has a smooth surface, and when it is mounted on a burning appliance, the gap between the wick and the wick guiding slit of the appliance is small, and flowing of the oil can be prevented in the event of tumbling of the burning appliance. Another advantage of needle punching is that the cut end of the needle-punched wick is not frayed, and a step of preventing fraying, required in sewing can be omitted. According to the stitch bonding method, on the other hand, the long fiber layers and the short fiber random web layers can be united by stitches, as shown in FIG. 8. Slight unevenness results on the surface of the stitch-bonded wick owing to the stitch yarns. However, since the short fiber random web layer is softer than conventional woven fabrics, the fit of the wick with the burning appliance is good, and the same advantage as in the case of the needle-punched wick can be obtained.

Figure 9:
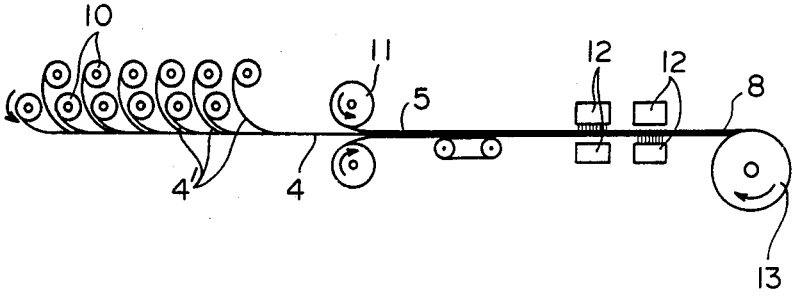
FIG. 9 is a flow sheet illustrating the process of manufacturing the wick of the invention from short fiber random web layers and long fiber layers.

With reference to FIG. 9, one example of the method of manufacturing the fuel absorbing section of the wick will be described. Twelve thin long fiber fabrics 4' are fed respectively from twelve wound packages 10 and stacked to form a long fiber layer 4. Short fiber random web layers 5 are supplied respectively to the top surface and back of the long fiber layer 4 from wound packages 11. Thereafter, the assembly is needle-punched by a needle-punching machine 12, and the resulting unitary structure 8 consisting of the long fiber layers and the short fiber layers is wound up on a rotating member 13. The structure 8 is then cut to a suitable size and becomes the fuel absorbing section 2 which is connected to the burning section 3 to form the wick of this invention.

In the fuel absorbing section of the wick, each long fiber layer has a basis weight of preferably about 20 to about 800 g/m$^2$, and each short fiber random web layer has a basis weight of preferably about 40 to about 600 g/m$^2$. The weight ratio of the long fiber layers (4) to the short fiber random web layers (5) is preferably 1:0.1–3, more preferably 1:0.2–2.

The wick of this invention has a heat-resistant burning section located upwardly of, and adjacent to, the fuel absorbing section.

The heat-resistant burning section is composed of a woven or knitted fabric of a heat-resistant material, preferably a woven or knitted fabric of glass fibers, carbon fibers or ceramic fibers. These woven or knitted fabrics produced from these fibers are well known in the art. For example, fibers composed mainly of silica and alumina (for example, a product of The Babcock & Wilcox Comany) may be used as the ceramic fibers.

The wick of this invention has a unitary structure obtained by sewing the fuel absorbing section and the burning section together to unite them physically, as shown in FIG. 1.

The wick may be in the form of a flat plate as shown in FIG. 5, or in a cylindrical form as shown in FIGS. 1 and 3, according to the shape of the burning appliance in which it is used.

The wick of this invention is suitable for use in such burning appliances as kerosene stoves and kerosene space heaters of the base tank or cartridge tank type. With a base tank-type burning appliance, the liquid level of fuel in the base tank is lowered as the burning time is prolonged. If, therefore, a conventional wick is used, the rate of absorbing the fuel gradually decreases to reduce the force of the flame or result in spontaneous extinguishing of the flame. This inconvenience, however, can be avoided by using the wick of this invention because its fuel absorbing section has such a high rate of fuel absorption that it can continue to supply the fuel at a fixed rate to the burning section even when the fuel level has been lowered.

Another characteristic feature of the wick of this invention is that its high rate of fuel absorption makes it possible to generate a large amount of heat and allow a large distance between the liquid level of the fuel in a tank and the upper end of the burning section, and because of this large distance, the fuel in the tank is prevented from being heated to a high temperature and consequently from being vaporized and exploded.

For example, the present invention can provide a wick whose fuel absorbing section has a fuel absorbing rate, as defined hereinbelow, of 110 seconds or less.

The fuel absorbing rate is measured by the method described in JIS S-2038-1977, Section 6.2 as follows:

The wick specimen is dried to a constant weight in a drying oven kept at a temperature of 110°±10° C., and then cooled in a desiccator until its temperature reaches room temperature (20°±15° C.) The specimen is then marked at 5 mm and 105 mm below its top, and dipped in kerosene (No. 1 according to JIS K-2203) up to the mark at 105 mm. Immediately after dipping, the time which has elapsed until the kerosene comes up to the mark at 5 mm is measured by a stopwatch. The time (seconds) so measured is defined as the absorbing rate.

The amount of kerosene absorbed is measured in accordance with the method described in JIS S-2038-1977, Section 6.1 as follows:

(1) A wick specimen is put in a drying oven kept at a temperature of 110°±10° C. and dried to a constant weight. It is then put in a desiccator and cooled to room temperature (20°±15° C.), and its mass is measured by a weighing device. The measured mass is designated as $W_o$.

(2) The specimen is then immersed for about 5 minutes in kerosene (No. 1 according to JIS K-2203) in an amount sufficient for the entire wick to be immersed in it.

(3) The specimen is then withdrawn from the kerosene and suspended in the air so that its burning section is up and horizontal. When oil droplets stop falling continuously from the bottom of the specimen and the time interval between the falling of one oil droplet and that of the next becomes about 5 minutes, the mass of the specimen is measured by a weighing device. The measured mass is designated as $W_1$.

(4) The amount of the oil absorbed is calculated from the following equation.

$$\text{Amount of the oil absorbed (wt. \%)} = \frac{W_1 - W_o}{W_o} \times 100$$

The following examples illustrate the present invention more specifically.

EXAMPLE 1

Many non-twisted tows of polyethylene terephthalate long fibers having a monofilament size of 1.5 denier and a total size of 30,000 denier were laid parallel to each other and mechanically vibrated so that the tows spread gradually and the individual monofilaments aligned nearly parallel to each other in a uniform thickness. An acrylate-type adhesive was applied to the spread tows to give a fabric having a basis weight (weight per unit area conventionally referred to as "metsuke" in the art in Japan) of 40 g/m$^2$ (4' in FIG. 9). Twelve such fabrics were stacked, and a random web (5 in FIG. 9) having a basis weight of 100 g/m$^2$ and composed of polyethylene terephthalate staples (3 denier×51 mm) was laid over each surface of the resulting stacked assembly. The entire assembly was needle-punched at a density of 200/cm$^2$ by a needle-punching machine (12 in FIG. 9) to unite them into an inseparable integral structure (8 in FIG. 9) having a thickness of 2.5 mm.

The resulting integral structure had a fuel absorbing rate of 95 seconds and fuel absorbing amount of 320% by weight, as measured by the methods described above.

The resulting integral structure was used as a fuel absorbing section and connected to a heat-resistant burning section composed of a woven fabric consisting entirely of glass fibers by sewing them together using a glass fiber thread to form a cylindrical wick as shown in FIG. 1 (in FIG. 1, the reference numeral 1 represents the wick body; 2, the absorbing section; and 3, the burning section). It was mounted on a double cylinder-type oil stove and subjected to a burning test.

The oil stove was of the base tank type (about 5.5 liters), and the liquid level of kerosene was about 15 cm below the top end of the wick when the base tank was full.

Figure 10:
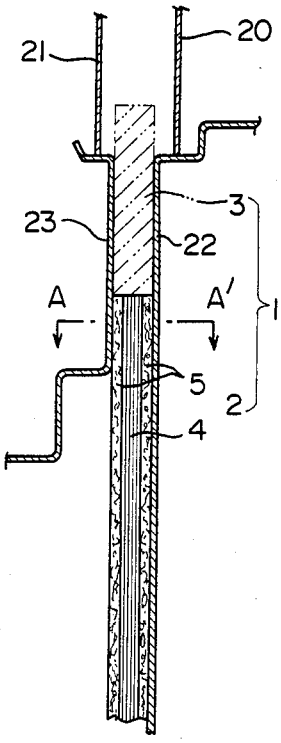
FIG. 10 is an enlarged sectional view showing the wick of the invention as mounted on a wick guiding cylinder of a double-cylinder kerosene heater.
Figure 11:
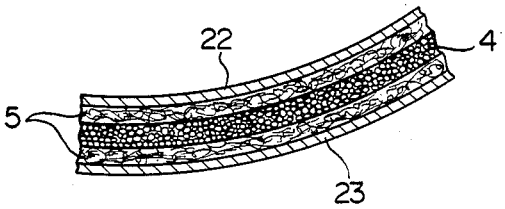
FIG. 11 is a cross-sectional view taken on line A—A' of FIG. 10.

FIG. 10 shows an enlarged sectional view of the state of the wick of this invention being mounted on the double cylinder-type oil stove including an inside burning cylinder 20 and an outside burning cylinder 21 which are connected respectively to an inside wick cylinder 22 and an outside wick cylinder 23 of an oil tank. FIG. 11 is a cross-sectional view taken on line A—A' of FIG. 10. It will be seen from FIGS. 10 and 11 that the wick of the invention has an excellent fit with the wick guide, i.e. the inside wick cylinder and the outside wick cylinder of the oil tank.

When the burning continued for 13 hours, the kerosene in the tank was consumed (at which time the decrease in the liquid level of the kerosene in the tank was 5 cm). During this time, the burning continued well until the flame extinguished, and no deterioration in the burning performance of the wick was noted.

EXAMPLE 2 AND COMPARATIVE EXAMPLE 1

An integrated structure having a thickness of 3 mm was produced in the same way as in Example 1 from one piece of rayon long fiber fabric (monofilament size: 2 denier) having a basis weight of 300 g/m$^2$ and two pieces of rayon random webs having a basis weight of 150 g/m$^2$.

A wick was produced from this integrated structure as a fuel absorbing section and a fabric of glass fibers as a burning section in the same way as in Example 1.

For comparison, a conventional wick was produced from a woven fabric containing 6 folded yarns of 10$^s$ cotton warps as a fuel absorbing section and the same burning section as mentioned above.

The performances of these wicks were compared by a burning test using a white-flame type (convection type) kerosene heater. When the tank was full, the amount of kerosene was 7 liters, and the distance from the liquid level of the kerosene to the upper end of the wick was about 10 cm.

The amount of kerosene consumed by the wick of this invention was 0.530 liter/hr (4,367 kcal/hr) when the tank was full and 0.490 liter/hr (4,037 kcal/hr) when the amount of kerosene decreased to about one-fourth of that when the tank was full.

With the conventional wick, the amount of kerosene consumed was 0.470 liter/hr (3,872 kcal/hr) and 0.398 liter (3,279 kcal/hr), respectively, at the times indicated above.

The results show that in comparison with the case of using the conventional wick, the absorption rate of the wick of this invention increased by 12.7% [(4,367 kcal/hr −3,872 kcal/hr) 3,872 kcal/hr×100=12.7%] when the tank was full of kerosene, and by 23.1% [(4,037 kcal/hr−3,279 kcal/hr) 3,279 kcal/hr×100=23.1%] when the amount of kerosene in the tank decreased, and therefore, because of such a high kerosene absorbing rate, burning with the wick of this invention produced a high caloric output. Furthermore, when the wick of this invention was used, the oil absorbing rate decreased only by 7.5% [(4,367 kcal/hr−4,037 kcal/hr)÷ 4,367 kcal/hr×100=7.5%] when the a decreased to one-fourth of the full amount, whereas with the conventional wick the decrease in oil absorbing rate was 15.3% [(3,872 kcal/hr−3,279 kcal/hr)÷ 3,872 kcal/hr ×100=15.3%] when the amount of the oil decreased to onefourth of the full amount. It is seen therefore that when the liquid level in the tank has been lowered with the consumption of the oil and the distance from the upper end of the burning section to the liquid level has thus increased, the rate of absorbing the oil by the wick of this invention does not greatly decrease, and the burning continues with a high caloric output.

EXAMPLE 3 AND COMPARATIVE EXAMPLE 2

The same wick as obtained in Example 2 in accordance with the invention and the same conventional wick as obtained in Comparative Example 1 were each subjected to a burning test in a radiating-type (net-type) oil stove. When the tank was full of kerosene, the amount of kerosene was 5.5 liters, and the distance between the liquid level of kerosene to the upper end of the wick was about 15 cm.

It was consequently found that with the wick of this invention, the amount of kerosene consumed was 0.293 liter/hr (2,414 kcal/hr) when the tank was full and 0.290 liter/hr (2,390 kcal/hr) when the amount of kerosene decreased to one-fourth of the full amount.

The amount of kerosene consumed by the conventional wick was 0.282 liter/hr (2,323 kcal/hr) and 0.261 liter/hr (2,150 kcal/hr), respectively, at the indicated times.

The above results show that the wick of this invention produces the same effect as obtained in Example 2 even when the type of the kerosene heater is changed.

What is claimed is:

1. A wick for use in a burning appliance consisting of (A) a fuel absorbing section having lower and upper ends, and (B) a heat-resistat burning section adjacent to said fuel absorbing section, wherein said fuel absorbing section is composed of one or a plurality of filament layers of numerous filaments aligned substantially in one direction and a plurality of web layers of randomly oriented staple fibers, said filaments not being substantially twisted and each of said filaments being continuous from the lower end to the upper end of the fuel absorbing section, said filament layers and web layers being alternately stacked so that the web layers from the outermost layers of the abosrbing section, and being physically united into an inseparable integral structure, and the fuel absorbing section having a fuel absorbing rate of at least 100 mm per 110 seconds.

2. The wick of claim 1 wherein the numerous filaments in the filament layers are selected from the group consisting of cellulose acetate fibers, polyamide fibers, acrylic fibers, polyester fibers, polyvinyl formal fibers, polyethylene fibers, polypropylene fibers, polyvinyl chloride fibers, wholly aromatic polyamide fibers, rayon, carbon fibers and glass fibers.

3. The wick of claim 1 wherein each web layer is composed of staple fibers selected from the group consisting of cellulose acetate fibers, polyamide fibers, acrylic fibers, polyester fibers, polyvinyl formal fibers, polyethylene fibers, polypropylene fibers, polyvinyl chloride fibers, wholly aromatic polyamide fibers, rayon, carbon fibers, glass fibers, cotton, flax and wool.

4. The wick of claim 1 wherein the filament layers and the web layers are physically united by needle punching.

5. The wick of claim 4 wherein the filament layers and web layers are needle-punched at a density of 50 to 400/cm$^2$ of its outermost surface on an average.

6. The wick of claim 1 wherein the filament layers and the web layers are physically united by stitch bonding.

7. The wick of claim 6 wherein the filament layers and the web layers are stitch-bonded with stitch yarns at a pitch of 1.5 to 5 mm and a density of 10 to 60 per 10 cm, said stitch yarns extending from the surface to the back of the stitch-bonded structure.

8. The wick of claim 1 wherein the heat-resistant burning section is composed of a woven fabric of a heat-resistant material.

9. The wick of claim 1 wherein the heat-resistant burning section is composed of a knitted fabric of a heat-resistant material.

10. The wick of claim 8 wherein the heat-resistant material is selected from the group consisting of glass fibers, carbon fibers and ceramic fibers.

11. The wick of claim 1 wherein each filament layer has a basis weight of 20 to 800 g/m$^2$.

12. The wick of claim 1 wherein each web layer has a basis weight of 40 to 600 g/m$^2$.

13. The wick of claim 1 wherein the weight ratio of the filament layers to the web layers is 1:0.2–2.

14. The wick of claim 1 which is in the form of a cylinder.

15. The wick of claim 1 which is in the form of a flat plate.

16. The wick of claim 1 wherein the fuel absorbing section consists of two of the web layers forming the outermost layers and one filament layer interposed therebetween.

17. The wick of claim 9 wherein the heat-resistant material is selected from the group consisting of glass fibers, carbon fibers and ceramic fibers.

18. The wick of claim 1 wherein the fuel absorbing section consists of two of the web layers forming the outermost layers, two of the filament layers respectively located inwardly of the web layers, and one web layer interposed between the two filament layers.

19. A wick for use in a burning appliance consisting of (A) a fuel absorbing section having lower and upper ends, and (B) a heat-resistant burning section adjacent to said fuel absorbing section, wherein said fuel absorbing section is composed of one or a plurality of filament layers of numerous filaments aligned substantially in one direction and a plurality of web layers of randomly oriented staple fibers, said filaments not be substantially twisted and each of said filaments being continuous from the lower end to the upper end of the fuel absorbing section, said filament layers and web layers being alternately stacked so that the web layers form the outermost layers of the absorbing section, and being physically united into an inseparable integral structure by needle punching, and the fuel absorbing section having a fuel absorbing rate of at least 100 mm per 110 seconds.

20. A wick for use in a burning appliance consisting of (A) a fuel abosrbing section having lower and upper ends, and (B) a heat-resistant burning section adjacent to said fuel absorbing section, wherein said fuel absorbing section is composed of one or a plurality of filament layers of numerous filaments aligned substantially in one direction and a plurality of web layers of randomly oriented staple fibers, said filaments not being substantially twisted and each of said filaments being continuous from the lower end to the upper end of the fuel absorbing section, said filament layers and web layers being alternately stacked so that the web layers form the outermost layers of the abosrbing section, and being physically united into an inseparable integral structure by stitch-bonding, and the fuel absorbing section having a fuel absorbing rate of at least 100 mm per 110 seconds.

* * * * *